US007211057B2

(12) United States Patent
Gleason et al.

(10) Patent No.: US 7,211,057 B2
(45) Date of Patent: May 1, 2007

(54) METHOD AND APPARATUS FOR PROVIDING HOT AND COLD MASSAGE

(75) Inventors: J. Neil Gleason, Milford, NH (US); Joseph Geringer, Merrimack, NH (US); Kenneth David Harris, Jr., Hollis, NH (US); Jay D. Newcomer, Manchester, NH (US); Charles J. Burout, Bedford, NH (US); Steven H. Schwartz, Bedford, NH (US); M. Rufus Woodward, Boston, MA (US)

(73) Assignee: Brookstone Purchasing, Merrimack, NH (US)

( * ) Notice: Subject to any disclaimer, the term of this patent is extended or adjusted under 35 U.S.C. 154(b) by 374 days.

(21) Appl. No.: 10/805,033

(22) Filed: Mar. 19, 2004

(65) Prior Publication Data

US 2005/0209537 A1 Sep. 22, 2005

(51) Int. Cl.
*A61H 1/00* (2006.01)

(52) U.S. Cl. ..... 601/46; 601/150

(58) Field of Classification Search ..... 601/46, 601/48, 67–68, 72–73, 150
See application file for complete search history.

(56) References Cited

U.S. PATENT DOCUMENTS

| | | | | |
|---|---|---|---|---|
| 4,513,735 | A | 4/1985 | Friedson et al. | |
| 4,604,993 | A * | 8/1986 | Moriwaki et al. | 601/18 |
| 4,722,326 | A | 2/1988 | Ruderian | |
| 4,730,605 | A | 3/1988 | Noble et al. | |
| D299,863 | S | 2/1989 | Noble et al. | |
| 4,878,489 | A | 11/1989 | Kamayachi | |
| 4,958,628 | A * | 9/1990 | Iwamoto et al. | 601/72 |
| 5,167,225 | A | 12/1992 | Cheng-I | |
| 5,501,682 | A | 3/1996 | Edwards-Cofie | |
| 5,573,500 | A | 11/1996 | Katsunuma et al. | |
| 5,593,212 | A * | 1/1997 | Praria et al. | 297/423.44 |
| 5,674,261 | A | 10/1997 | Smith | |
| 5,681,266 | A | 10/1997 | Lin | |
| 5,716,332 | A | 2/1998 | Noble | |
| 5,772,615 | A | 6/1998 | Elder et al. | |
| 5,785,668 | A | 7/1998 | Shimizu | |
| 5,827,205 | A | 10/1998 | Iwamoto | |
| 5,868,688 | A | 2/1999 | Avidor et al. | |
| D415,838 | S | 10/1999 | Noble | |

(Continued)

FOREIGN PATENT DOCUMENTS

WO WO03082178 A2 * 3/2003

OTHER PUBLICATIONS

Sharper Image, Three-in-One Flex Head Massager, YA001, www.sharperimage.com.

(Continued)

*Primary Examiner*—Michael A. Brown
(74) *Attorney, Agent, or Firm*—Nixon Peabody, LLP

(57) ABSTRACT

The massage device has a housing, which includes a massage head integral with the housing. The massage head has a first massaging surface. A heating element, integral with the housing, is positioned sufficiently proximate to the first massaging surface to raise a temperature of the first massaging surface above ambient temperature. The massage device also includes a massage head cover formed to engage the massage head, said massage head cover comprising a second massaging surface and a freezable material.

21 Claims, 6 Drawing Sheets

U.S. PATENT DOCUMENTS

| | | | |
|---|---|---|---|
| 6,053,881 | A | 4/2000 | Boodramsingh et al. |
| 6,077,238 | A | 6/2000 | Chung |
| 6,165,145 | A | 12/2000 | Noble |
| D435,913 | S | 1/2001 | Harris et al. |
| D438,308 | S | 2/2001 | Harris et al. |
| D454,959 | S | 3/2002 | Harris et al. |
| 6,432,072 | B1 | 8/2002 | Harris et al. |
| D466,217 | S | 11/2002 | Harris et al. |
| D466,612 | S | 12/2002 | Harris et al. |
| 6,494,849 | B2 | 12/2002 | Kuo |
| 6,500,135 | B2 | 12/2002 | Huang |
| D476,746 | S | 7/2003 | Harris et al. |
| 6,602,212 | B1 | 8/2003 | Ahn |
| 6,730,050 | B2 | 5/2004 | Huang |
| 6,733,406 | B2 | 5/2004 | Kitai et al. |
| 6,733,466 | B2 | 5/2004 | Huang |
| 6,758,826 | B2 * | 7/2004 | Luettgen et al. ..... 601/73 |
| 6,786,878 | B2 | 9/2004 | Dehli |
| 6,837,861 | B2 | 1/2005 | Lin |
| D510,441 | S | 10/2005 | Harris, Jr. et al. |
| 6,981,954 | B2 | 1/2006 | Huang |
| 2001/0027280 | A1 | 10/2001 | Huang |
| 2002/0161315 | A1 | 10/2002 | Harris et al. |
| 2002/0169400 | A1 | 11/2002 | Huang |
| 2002/0193712 | A1 | 12/2002 | Huang |
| 2003/0009116 | A1 | 1/2003 | Luettgen et al. |
| 2003/0028134 | A1 | 2/2003 | Lev et al. |
| 2004/0176710 | A1 | 9/2004 | Kennedy et al. |
| 2005/0010141 | A1 | 1/2005 | Mordechai et al. |
| 2005/0020947 | A1 | 1/2005 | Dehli |
| 2005/0049529 | A1 | 3/2005 | Ferber et al. |

OTHER PUBLICATIONS

ActiveForever.com, Dr. Scholls Perfect Reach Thermal Massager, A12040, www.activeforever.com.

Brookstone, Theraspa Turbo Massage, www.brookstone.com.

Homedics, HydraGel Infrared Massager, HG-2, www.homedics.com.

Homedics, Infra Tech Max Dual Heat Massager, IR-610, www.homedics.com.

Homedics, HydraGel Rechargeable Massager, HG-1, www.homedics.com.

* cited by examiner

METHOD AND APPARATUS FOR PROVIDING HOT AND COLD MASSAGE

TECHNICAL FIELD

The present invention is generally related to massagers and more particularly to a system and method for providing a hot massage or cold massage.

BACKGROUND OF THE INVENTION

Individuals generally, develop sore muscles and general aches and pains during the course of daily events. If muscles located in the back, shoulders, legs, feet or other areas become extremely tired, the circulation of the blood becomes sluggish, causing the compression of various nerves near the muscles. Recovery from fatigue of various muscles is delayed by the compressed nerves. Therefore, stimulation of the sore, aching, or tired muscles, which increases blood flow in the various muscles, hastens recovery from these general muscle maladies.

In folk medicine, simple mechanical objects without moving parts and of various designs were created for kneading troubled muscles in an attempt to increase blood flow. In Asian medicine, massage and acupuncture are used to stimulate an acupoint at which vital nerves are concentrated. More recently, doctors, personal trainers, and other experts in the field apply heat or cold to muscles in an attempt to alleviate the general muscle maladies. Also, more recently, many types of electronic massage devices have been created for promoting circulation of blood in the various troubled muscles.

There are several different techniques to massage troubled muscles and each technique provides different relief to the muscles. Vibratory massage applies a percussive force to the muscles that loosens tight muscles and encourages blood flow. Heat similarly loosens tight muscles and encourages blood flow, although more slowly than vibratory massage. The benefit of massage through heat over vibratory massage is that massage through heat is gentler on sore muscles. Cold massage can reduce swelling and inflammation in muscles and is often used to treat microtraumas in tendons, joints and bones. Each of these massage techniques, in their own ways, are useful in relieving troubled muscles.

The many types of electronic massage devices currently on the market have various characteristics. Some devices provide vibratory massage. Some devices provide heat massage. A couple of devices provide cold massage. Ideally, a massage device would be capable of relieving muscle aches through all three of these massage techniques.

Electronic massage devices that provide massage through heat, usually consume significant amounts of power. Electrically warming a massage head on the massage device is normally achieved with a resistive heating element, which requires a significant current to be warmed and to stay warm. Similarly, most cooling devices draw significant power. Ideally, a massage device would be capable of either heat or cold massage without consuming significant amounts of power.

Thus, a heretofore-unaddressed need exists in the industry to address the aforementioned deficiencies and inadequacies.

SUMMARY OF THE INVENTION

Embodiments of the present invention provide an apparatus and method for providing a hot or cold massage.

Briefly described, in architecture, one embodiment of the system, among others, can be implemented as a massage device, as follows. The massage device has a housing, which includes a massage head integral with the housing. The massage head has a first massaging surface. A heating element, integral with the housing, is positioned sufficiently proximate to the first massaging surface to raise a temperature of the first massaging surface above ambient temperature when the heating element is at an above ambient temperature. The massage device also includes a massage head cover formed to engage the massage head. The massage head cover includes a second massaging surface and a material that is capable of being cooled or frozen.

The present invention can also be viewed as providing methods for massaging. In this regard, a first method, among others, can be broadly summarized by the following steps: warming a first massaging surface on a massage head to above ambient temperature; beginning to massage with the massage head while the massage head cover is above ambient temperature; cooling a massage head cover to below ambient temperature; attaching the massage head cover to the massage head; and massaging with the massage head cover while the massage head cover is below ambient temperature.

A second method, among others, for providing a massage can be broadly summarized by the following steps: cooling one massage head cover to below ambient temperature; attaching the massage head cover to a massage head; and massaging the sore muscle with the massage head cover and massage head while the massage head cover is below ambient temperature.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
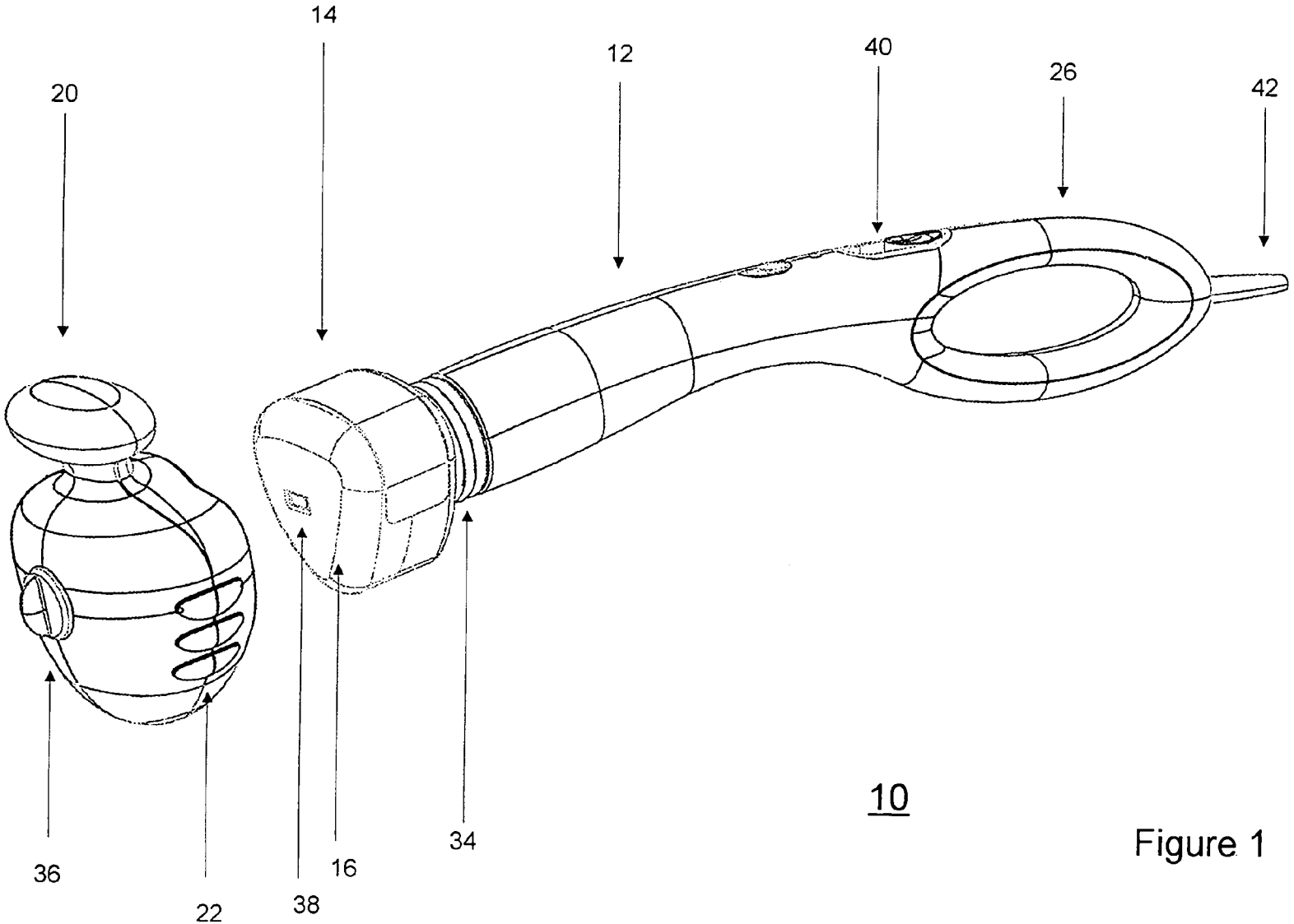
FIG. 1 is a perspective view of a first exemplary embodiment of the present invention having the massage head 14 and the massage head cover 20 separated.
Figure 2:
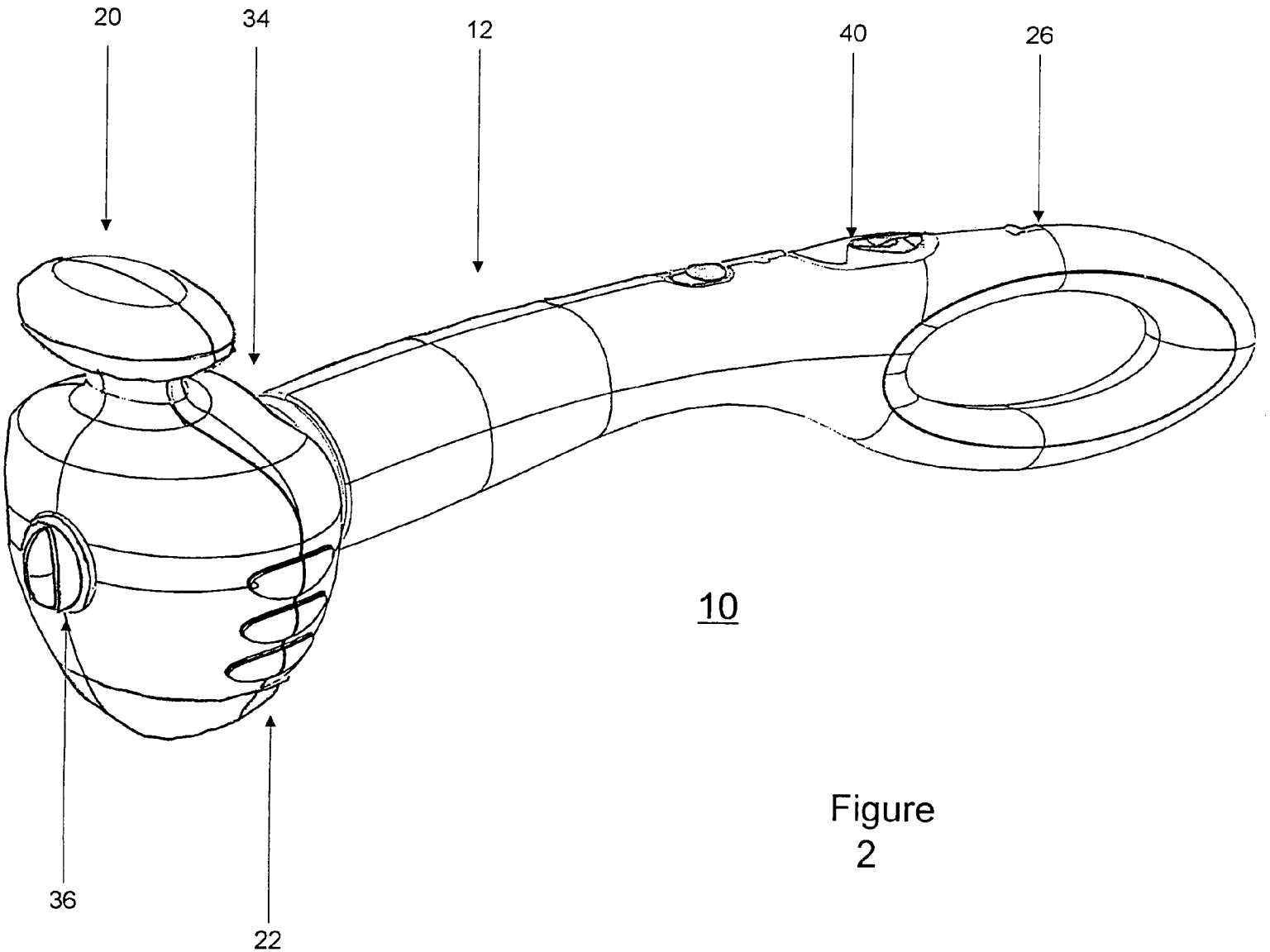
FIG. 2 is a perspective view of the first exemplary embodiment shown in FIG. 1 having the massage head cover 20 secured to the massage head 14.

In accordance with a first exemplary embodiment of the present invention, FIGS. 1 through 4 illustrate a massage device 10. The massage device 10 includes a housing 12, which is substantially a body of the massage device 10. A massage head 14 is integral with the housing 12. A first massaging surface 16 is integral with the massage head 14. The housing 12 contains a heating element 18 positioned sufficiently proximate to the first massaging surface 16 to raise a temperature of the first massaging surface 16 above ambient temperature when the heating element 18 is at an above ambient temperature. The massage device 10 also includes a massage head cover 20 formed to engage the massage head 14. The massage head cover 20 includes a second massaging surface 22 and is at least partially constructed from a freezable material 24. It should be noted that the freezable material 24 may instead be a coolable material that does not freeze.

Figure 3:
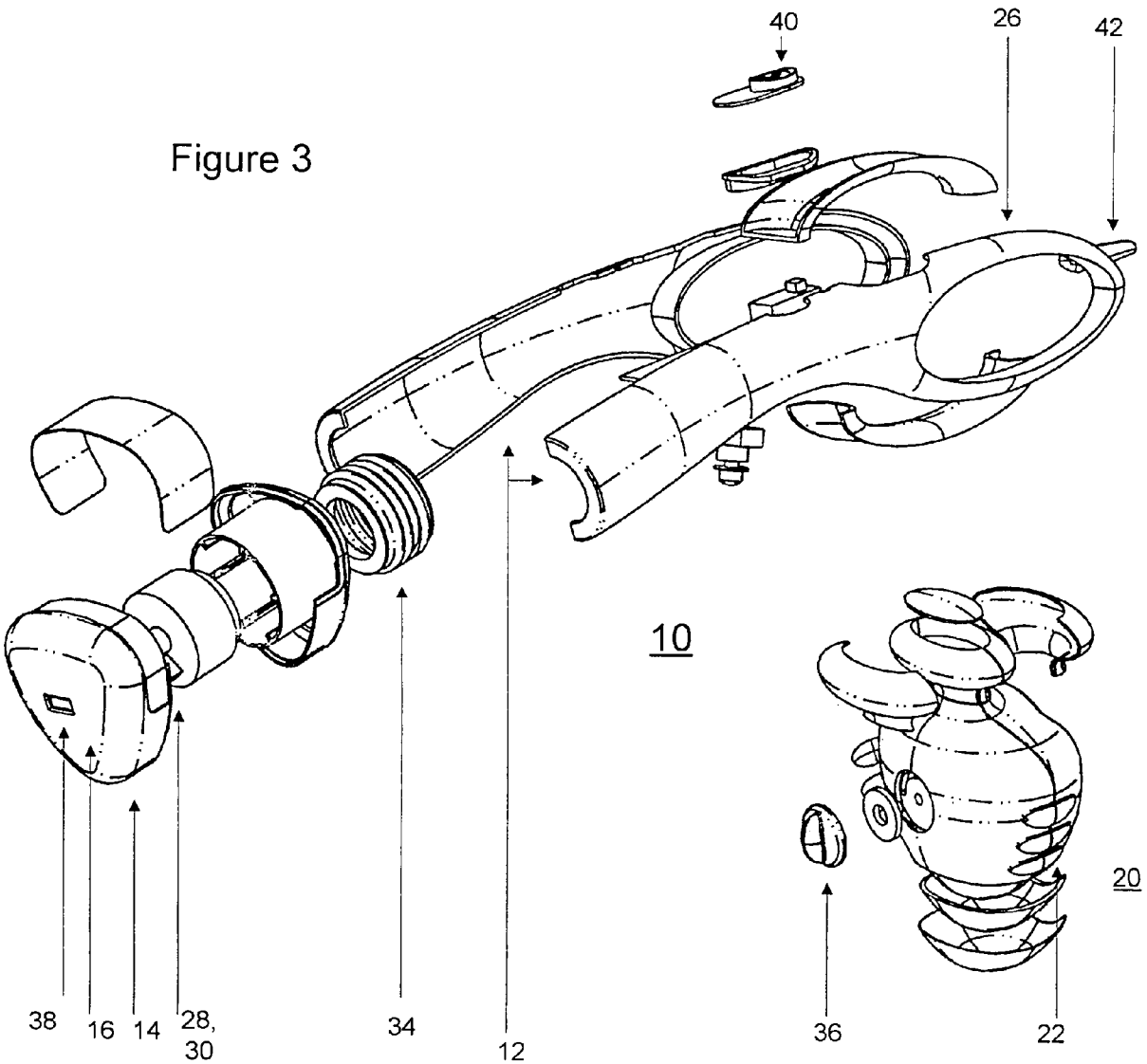
FIG. 3 is an exploded view of the first exemplary embodiment shown in FIG. 1.
Figure 4:
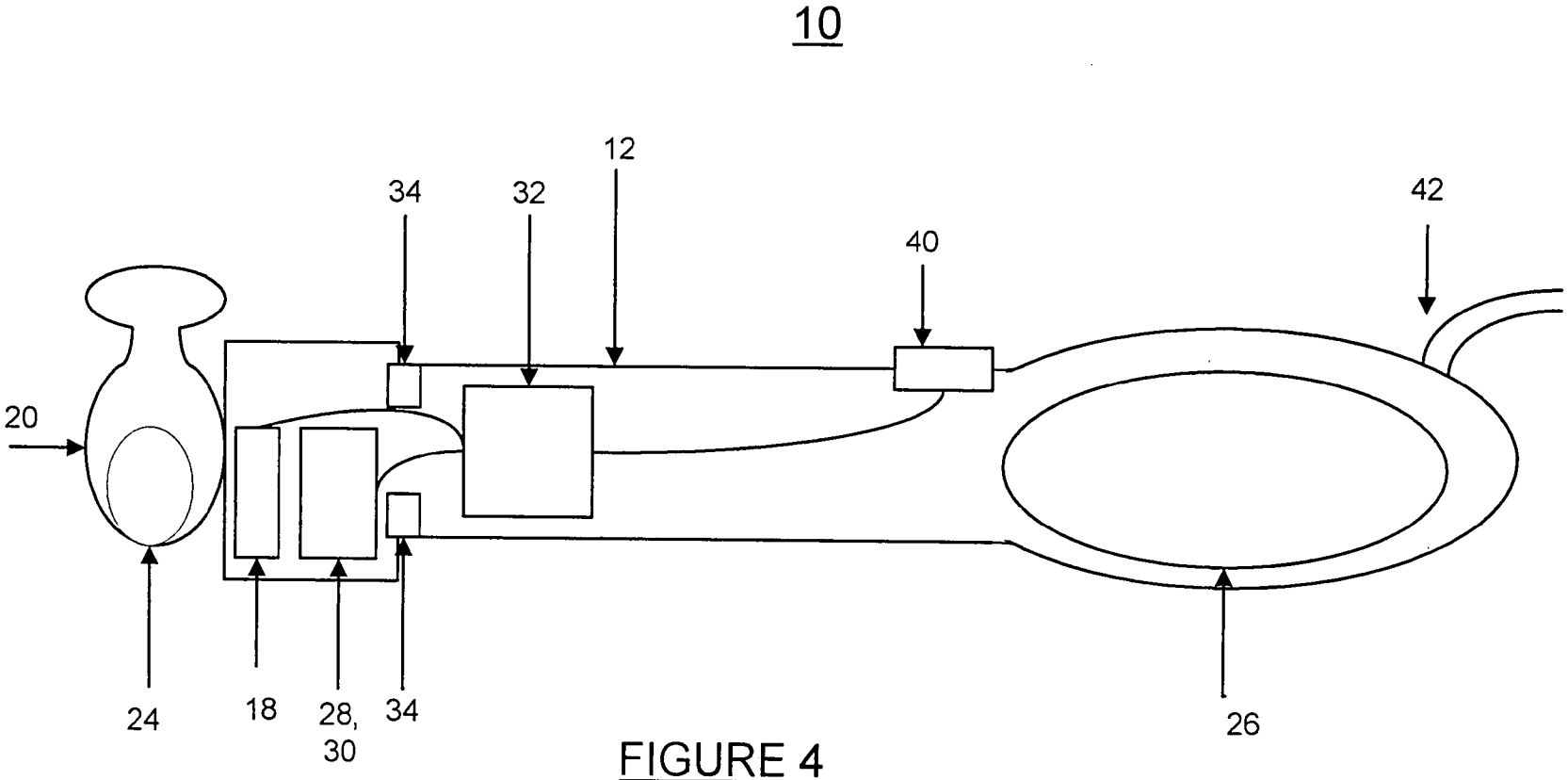
FIG. 4 is a cross-sectional view of the first exemplary embodiment shown in FIG. 1.

The housing 12 can be constructed in many different ways. The first exemplary embodiment of the massage device 10, as shown in FIG. 3, uses a housing 12 that has a hollow, somewhat cylindrical shape. However, the housing 12 can be formed in any shape imaginable and, presently, a plethora of massage devices of varying shapes and sizes are known to those skilled in the art. The housing 12 is intended to at least partially house the electronics associated with the massage device 10 and, more specifically, the massage head 14 and heating element 18. If, as shown in the first exemplary embodiment, the massage device 10 is designed to be handheld, a handle 26 may be attached to the housing 12.

The massage head 14 has a wide range of structure possibilities. The massage head 14, as shown in the first exemplary embodiment, is wider than the housing 12, and contains the elements for providing heat and vibratory massage. The massage head 14 also has a first massaging surface 16, which may be smooth, covered in nodules, or otherwise crafted for providing a massaging touch to aching muscles. The massage head 14 may include a percussive massage element 28 designed to cause the massage head 14 to vibrate.

Many designs for the percussive massage element 28 are known to those skilled in the art. One possible design for the percussive massage element 28 is a rotatable, off-balance weight 30. The off-balance weight 30 is driven to rotate by a motor 32 within the massage device 10. Also, a counterweight 34 may be provided in the massage head 14 to inhibit percussive force from the percussive massage element 28 from translating down the handle 26 of the massage device 10.

The massage head cover 20 may be designed to be microwaveable or may contain an insert that is microwaveable. The massage head cover 20 also has the second massaging surface 22, which may be smooth, covered in nodules, or otherwise crafted for providing a massaging touch to aching muscles. The second massaging surface 22 may be designed to translate percussive force from the percussive massage element 28 to the user. The massage head cover 20 may be designed to easily conduct temperatures, including, but not limited to, that of the heating element 18 or the freezable material 24. The massage head cover 20 may be designed to easily conduct temperatures at the second massaging surface 22. The massage head cover 20 may also include an insert joined to the second massaging surface 22, wherein said insert is the freezable material 24. The freezable material 24 may include a freezable gel.

As shown in FIG. 1, the massage device 10 contains further features. As discussed, the massage head cover 20 is formed to engage the massage head 14. According to the first exemplary embodiment, a thumbscrew 36 may be attached to a tab (not shown) running through the massage head cover 20. The tab is insertable into a massage head slot 38. Turning the thumbscrew 36, after the tab has been inserted into the massage head slot 38, engages the massage head cover 20 to the massage head 14. This engagement is designed to withstand any percussive force from the percussive massage element 28. Many variations and modifications of the engagement in the first exemplary embodiment may be made without departing substantially from the spirit and principles of the massage device 10.

The first exemplary embodiment shown in FIG. 1 also contains elements for controlling operation of the massage device 10. The massage device 10 includes a control panel 40. The control panel 40 may include an on/off switch for either or both of the percussive massage element 28 and for the heating element 18. The control panel 40 may include buttons for controlling the intensity of the percussive force from the percussive massage element 28 and/or the intensity of the heat from the heating element 18. Other controls for controlling the features of the massage device 10 herein described may further be included with the control panel 40. The massage device 10 also includes an electrical cord 42 for receiving power from a wall outlet, although power may be provided alternatively or in combination with a battery.

Figure 5:
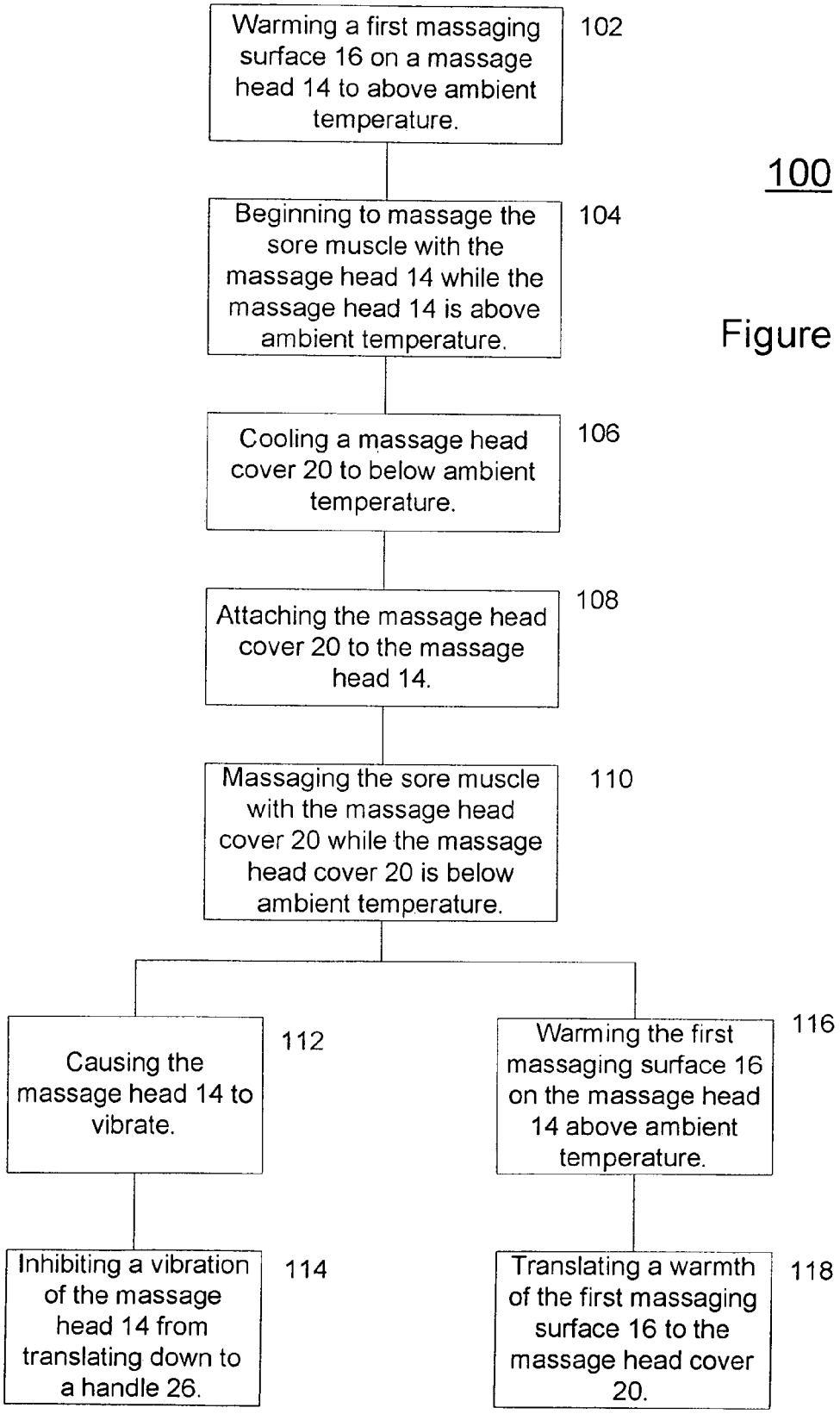
FIG. 5 is a flow chart of a first possible use of the first exemplary embodiment of the present invention.
Figure 6:
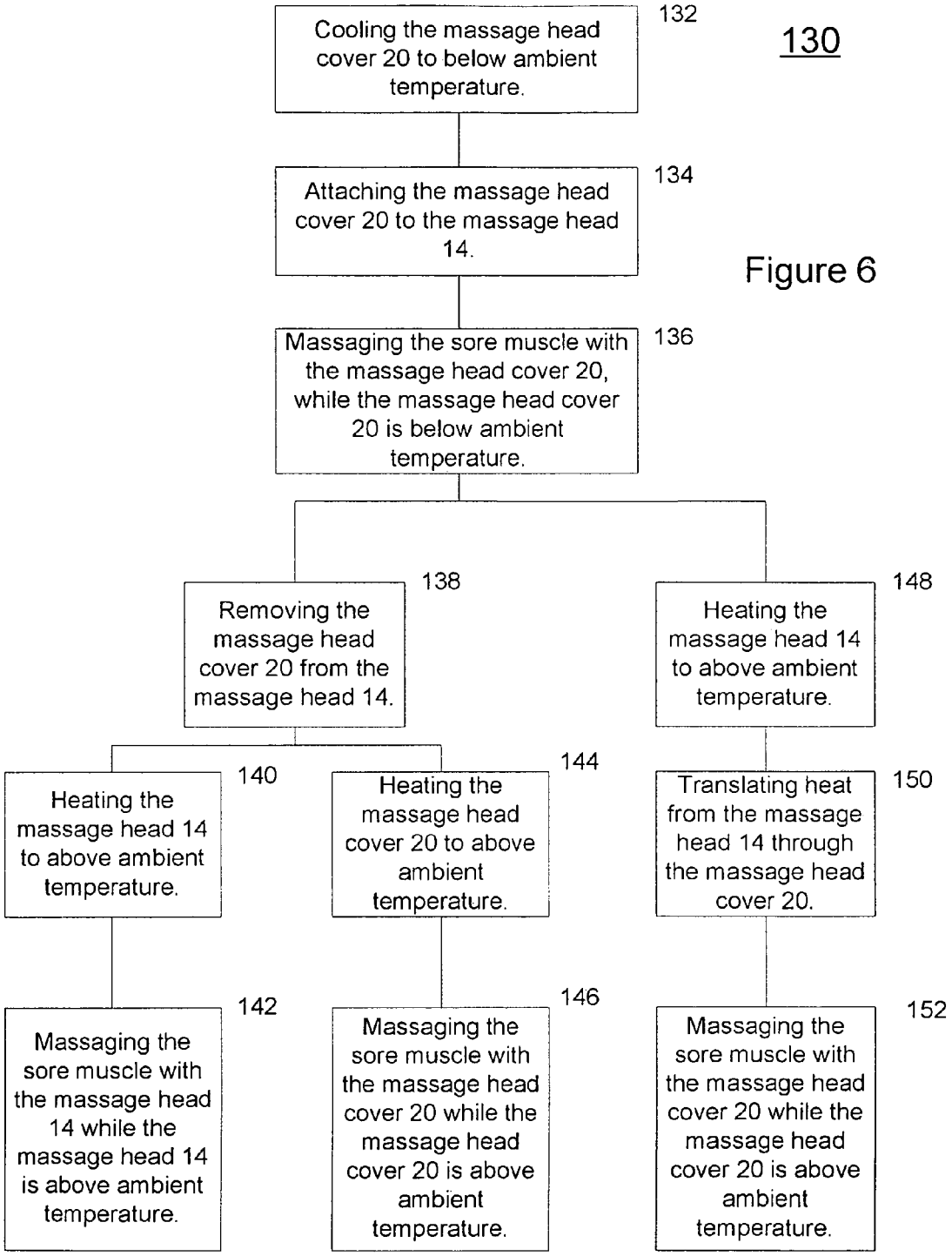
FIG. 6 is a flow chart of a second possible use of the first exemplary embodiment of the present invention.

FIG. 5 and FIG. 6 are flowcharts illustrating the architecture, functionality, and operation of a possible implementation of the first exemplary embodiment of the massage device 10 of FIG. 1. In this regard, each block represents a module or segment, which comprises one or more executable instructions for implementing the specified function(s). It should also be noted that in some alternative implementations, the functions noted in the blocks may occur out of the order noted in the flow charts. For example, two blocks shown in succession may in fact be executed substantially concurrently or the blocks may sometimes be executed in the reverse order, depending upon the functionality involved, as will be further clarified herein below.

A first method 100 of treating a sore muscle using the massage device 10 is shown in FIG. 5. The first method 100 includes a step of warming 102 a first massaging surface 16 on a massage head 14 to above ambient temperature. Another step in the method is beginning 104 to massage the sore muscle with the massage head 14 while the massage head 14 is above ambient temperature. The step of beginning 104 to massage may be completed, for example, by kneading the first massaging surface 16 on the massage head 14 against the sore muscle in a rote motion. Another step in the first method 100 is cooling 106 a massage head cover 20 to below ambient temperature. Another step in the first method 100 is attaching 108 the massage head cover 20 to the massage head 14. The step of attaching 108 the massage head cover 20 to the massage head 14 may be completed, for example, by inserting the thumbscrew 36 tab into the massage head slot 40 and turning the thumbscrew 36. Another step in the first method 100 is massaging 110 the sore muscle with the massage head cover 20 while the massage head cover 20 is below ambient temperature.

The method 100 of treating a sore muscle using the massage device 10 may include additional steps. One additional possible step is the step of causing 112 the massage head cover 20 to vibrate. The step of causing 112 the massage head cover 20 to vibrate may be accomplished, for example, by causing the off-balance weight 30 to rapidly rotate, which will generate vibrations within the massage head 14 and those vibrations will translate to the massage head cover 20. The step of causing 112 the massage head cover 20 to vibrate may also be accomplished, for example, by generating percussive force with the percussive massage element 28 in the massage head 14 and that percussive force will translate to the massage head cover 20, causing it to vibrate. A related additional step includes step of inhibiting 114 a vibration of the massage head 14 from translating down to a handle 26 attached to the massage head 14. The step of inhibiting the vibration of the massage head 14 may be accomplished by attaching a counterweight 34 to the massage device 10, between the massage head 14 and the handle 26. Many variations and modifications for causing the massage head 14 to vibrate in the first method 100 may be made without departing substantially from the spirit and principles of the step of causing 112 the massage head cover 20 to vibrate.

A separate additional possible set of steps include a step of warming 116 the first massaging surface 16 on the massage head 14 to above ambient temperature. The step of warming 116 the first massaging surface 16 may be accomplished, for instance, by engaging the heating element. A second step in the additional possible set of steps includes translating 118 a warmth of the first massaging surface 16 to the massage head cover 20 to increase a temperature of the massage head cover 20 to above ambient temperature.

A second method 130 of treating a sore muscle using the massage device 10 is shown in FIG. 6. One step of the second method is cooling 132 one massage head cover 20 to below ambient temperature. The step of cooling 132 the massage head cover 20 may be performed by freezing the massage head cover 20, wherein the massage head cover 20 contains a freezable material 18, or by freezing a freezable material 18, which is then inserted into the massage head cover 20. Another step of the second method is attaching 134 the massage head cover 20 to a massage head 14. The step of attaching 134 the massage head cover 20 to the massage head 14 may be completed, for example, by inserting the thumbscrew 36 tab into the massage head slot 40 and turning the thumbscrew 36. Another step of the second method 130 is massaging 136 the sore muscle with the massage head cover 20 while the massage head cover 20 is below ambient temperature. The step of massaging 136 the sore muscle may be completed, for example, by kneading the second massaging surface 22 of the massage head 14 against the sore muscle in a rote motion.

The second method 130 of treating a sore muscle using the massage device 10 may include additional sets of steps. One additional possible set of steps may include the step of removing 138 the massage head cover 20 from the massage head 14. Another step in this additional set of steps is heating 140 the massage head 14 to above ambient temperature. The step of heating 140 the massage head 14 may be accomplished by warming the heating element 18 in the massage head 14. Another step is this additional set of steps is massaging 142 the sore muscle with the massage head 14 while the massage head 14 is above ambient temperature.

The second method 130 of treating a sore muscle using the massage device 10 may include another additional sets of steps. One additional possible set of steps may include the step of removing 138 the massage head cover 20 from the massage head 14. Another step in this additional set of steps is heating 144 the massage head cover 20 to above ambient temperature without the aid of the heating element 18. The step of heating 144 the massage head cover 20 may be accomplished, for instance, by heating the massage head cover 20, microwaving the massage head cover 20, or by heating or microwaving an insert to be placed in the massage head cover 20. Another step in this additional set of steps is massaging 146 the sore muscle with the massage head cover 20 while the massage head cover 20 is above ambient temperature. The step of massaging 146 the sore muscle with the massage head cover 20 may be accomplished with or without the massage head cover 20 engaged with the massage head 14.

The second method 130 of treating a sore muscle using the massage device 10 may include another additional sets of steps. One additional possible set of steps may include the step of heating 148 the massage head 14 to above ambient temperature. The step of heating 148 the massage head 14 may be accomplished by warming the heating element 18 in the massage head 14. Another step in this set of additional steps is translating 150 heat from the massage head 14 through the massage head cover 20. Another step in this set of additional steps is massaging 152 the sore muscle with the massage head cover 20 while the massage head cover 20 is above ambient temperature. The step of massaging 152 the sore muscle with the massage head cover 20 may be accomplished with or without the massage head cover 20 engaged with the massage head 14.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

We claim:

1. A massage device comprising:

a housing;

a massage head integral with the housing;

a first massaging surface integral with the massage head;

a heating element integral with the housing, said heating element positioned proximate to the first massaging surface;

a massage head cover formed to engage the massage head, said massage head cover comprising a second massaging surface and a freezable material; and a thumbscrew adapted to removably attach the massage head cover to the massage head.

2. The massage device of claim 1 wherein the massage head cover is microwaveable.

3. The massage device of claim 1 further comprising a handle on the housing.

4. The massage device of claim 1 wherein the massage head cover further comprises a rigid surface that translates temperatures and an insert joined to the surface, wherein said insert is freezable.

5. The massage device of claim 1 further comprising a percussive massage element in the massage head.

6. The massage device of claim 5 wherein the percussive massage element in the massage head further comprises a rotatable, off-balance weight whereby rotating the rotatable, off-balance weight causes the massage head to vibrate.

7. The massage device of claim 6 further comprising a counterweight in the massage head whereby the percussive force is inhibited from translating down the housing.

8. The massage device of claim 6 wherein the percussive massage element further comprises nodules located on a surface of the massage head cover thereby translating massaging percussive force to a user through the nodules.

9. The massage device of claim 1 wherein the massage head cover further comprises nodules located on a surface of the massage head cover thereby being capable of translating massaging percussive force to a user through the nodules.

10. The massage device of claim 1 wherein the massage head cover translates heat from the first massaging surface.

11. A method of treating a sore muscle comprising the steps of:

warming a first massaging surface on a massage head to above ambient temperature;

beginning to massage the sore muscle with the massage head while the massage head cover is above ambient temperature;

cooling a massage head cover to below ambient temperature;

attaching, with a thumbscrew, the massage head cover to the massage head; and massaging the sore muscle with the massage head cover while the massage head cover is below ambient temperature.

12. The method of claim 11 further comprising the step of causing the massage head cover to vibrate.

13. The method of claim 12 further comprising the step of inhibiting a vibration of the massage head from translating down to a handle attached to the massage head.

14. The method of claim 11 further comprising the step of:

warming the first massaging surface on the massage head to above ambient temperature; and translating a warmth of the first massaging surface to the massage head cover to increase a temperature of the massage head cover to above ambient temperature.

15. A method of treating a sore muscle comprising the steps of:

cooling one massage head cover to below ambient temperature;

attaching, with a thumbscrew, the massage head cover to a massage head; and massaging the sore muscle with the massage head cover and massage head while the massage head cover is below ambient temperature.

16. The method of claim 15 further comprising the steps of:

removing the massage head cover from the massage head;

heating the massage head to above ambient temperature; and massaging the sore muscle with the massage head while the massage head is above ambient temperature.

17. The method of claim 15 further comprising the steps of:

removing the massage head cover from the massage head;

heating the massage head cover to above ambient temperature; and massaging the sore muscle with the massage head cover while the massage head cover is above ambient temperature.

18. The method of claim 15 further comprising the steps of:

heating the massage head to above ambient temperature;

translating heat from the massage head through the massage head cover; and massaging the sore muscle with the massage head cover while the massage head cover is above ambient temperature.

19. The massage device of claim 1, further comprising a slot on the massage head, wherein the thumbscrew attaches the massaged head cover to the slot.

20. The method of claim 11, wherein attaching, with a thumbscrew, the massage head cover to the massage head comprises attaching, with a thumbscrew, the massage head cover to a slot on the massage head.

21. The method of claim 15, wherein attaching, with a thumbscrew, the massage head cover to the massage head comprises attaching, with a thumbscrew, the massage head cover to a slot on the massage head.

* * * * *